US006236821B1

(12) United States Patent
Yokoyama et al.

(10) Patent No.: US 6,236,821 B1
(45) **Date of Patent: *May 22, 2001**

(54) PROCESS CARTRIDGE HAVING A COUPLING PIN AND A COUPLING PIN COMPRISING FIRST, SECOND, AND THIRD SHAFT PORTION

(75) Inventors: Katsunori Yokoyama, Susono; Kazushi Watanabe, Mishima; Atsushi Numagami, Hadano, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/102,611

(22) Filed: Jun. 23, 1998

(30) Foreign Application Priority Data

Jun. 23, 1997 (JP) ..... 9-181796

(51) Int. Cl.[7] ..... G03G 15/00

(52) U.S. Cl. ..... 399/113

(58) Field of Search ..... 399/111, 113, 399/116, 119

(56) References Cited

U.S. PATENT DOCUMENTS

| | | | | |
|---|---|---|---|---|
| 5,294,960 | | 3/1994 | Nomura et al. | 355/210 |
| 5,623,328 | | 4/1997 | Tsuda et al. | 399/111 |
| 5,640,229 | * | 6/1997 | Nakahara | 399/119 |
| 5,659,847 | | 8/1997 | Tsuda et al. | 399/113 |
| 5,749,027 | * | 5/1998 | Ikemoto et al. | 399/113 |
| 5,752,131 | * | 5/1998 | Fujiwara et al. | 399/11 X |
| 5,768,669 | * | 6/1998 | Yokoyama | 399/111 X |
| 5,774,766 | * | 6/1998 | Karakama et al. | 399/111 |
| 5,828,928 | | 10/1998 | Sasago et al. | 399/111 |
| 5,937,242 | | 8/1999 | Yokoyama et al. | 399/114 |

* cited by examiner

*Primary Examiner*—Fred L Braun
(74) *Attorney, Agent, or Firm*—Fitzpatrick, Cella, Harper & Scinto

(57) ABSTRACT

A coupling pin for coupling a first frame and a second frame of a process cartridge detachably mountable relative to a main assembly of an electrophotographic image forming apparatus includes (a) a first shaft portion for being press-fitted into a first hole formed in the first frame; and (b) a second shaft portion for being press-fitted into a second hole formed in the first frame, where the second shaft portion is upstream of the first shaft portion in a direction of press-fitting of the coupling pin. The second shaft portion has an outer diameter which is larger than that of the first shaft portion. The pin further includes (c) a third shaft portion for being loosely fitted into a hole formed in the second frame with a gap between the third shaft portion and inside surface of the hole of the second shaft.

35 Claims, 9 Drawing Sheets

PROCESS CARTRIDGE HAVING A COUPLING PIN AND A COUPLING PIN COMPRISING FIRST, SECOND, AND THIRD SHAFT PORTION

FIELD OF THE INVENTION AND RELATED ART

The present invention relates to a connecting pin that is used in a process cartridge removably installable in an electrophotographic image forming apparatus, and the process cartridge. In this specification, electrophotographic image forming apparatus refers to an apparatus which forms an image on recording medium with the use of an electrophotographic image forming system. It includes an electrophotographic copying machine, an electrophotographic printer (laser beam printer, LED printer, or the like), a facsimile machine, a word processor, and the like.

The term a "process cartridge" refers to a cartridge that is rendered removably installable in the main assembly of an electrophotographic image forming apparatus, and integrally comprises an electrophotographic photosensitive member, and at least one of three means: a charging means for charging an electrophotographic photosensitive member; a developing means for developing a latent image formed on the peripheral surface of the electrophotographic photosensitive member; and a cleaning means for removing the developer remaining on the peripheral surface of the electrophotographic photosensitive member.

In some of the image forming apparatuses which employ an electrophotographic photosensitive image forming system, a process cartridge system is employed. In the case of this type of process cartridge system, an electrophotographic photosensitive member, and one or more processing means, which work with the electrophotographic photosensitive member, are integrally placed in a cartridge. With the employment of this type of process cartridge system, the image forming apparatus can be maintained by a user himself, without the need for relying on service personnel, and therefore, the usability of the apparatus is greatly improved.

A typical structure of such a process cartridge comprises two frames, for example, a cleaning unit frame and an image developing unit frame, which are connected to each other. The cleaning unit frame contains an electrophotographic photosensitive drum, a charging device, and a cleaning device, and the image developing unit frame comprises an image developing means frame and a toner frame. The developing means frame supports a developing means, and the toner frame constitutes a toner chamber. The cleaning unit frame, and the image developing unit frame are connected in such a manner that the two frames are rendered pivotable about a connecting pin (axis). Further, the two frames are kept under such force that is generated with the use of an elastic member, for example, a spring, and that maintains a predetermined positional relationship between the photosensitive drum and the developing means. This two piece structure has various functional advantages and merits. For example, the two piece structure makes it easier to keep the pressure applied upon the photosensitive drum by an image developing roller, at a proper level, and it is also easier to maintain the proper gap between the peripheral surfaces of the photosensitive drum and the image developing roller. Further, the two piece structure makes it easier to mold the structural components of the process cartridge, and also to assemble the components into the process cartridge.

SUMMARY OF THE INVENTION

Accordingly, the primary object of the present invention is to provide a connecting pin which assures that the two frames of a process cartridge are properly connected.

Another object of the present invention is to provide a connecting pin which does not easily disengage from the frames of a process cartridge.

Another object of the present invention is to provide a coupling pin for coupling a first frame and a second frame of a process cartridge detachably mountable relative to a main assembly of an electrophotographic image forming apparatus, comprising: (a) a first shaft portion for being press-fitted into a first hole formed in the first frame; (b) a second shaft portion for being press-fitted into a second hole formed in the first frame, wherein the second shaft portion is upstream of the first shaft portion in a direction of press-fitting of the coupling pin, and the second shaft portion has an outer diameter which is larger than that of the first shaft portion; and (c) a third shaft portion for being loosely fitted into a hole formed in the second frame with a gap between the third shaft portion and inside surface of the hole of the second shaft.

Another object of the present invention is to provide a process cartridge that comprises two frames connected with the connecting pin described above.

These and other objects, features and advantages of the present invention will become more apparent upon a consideration of the following description of the preferred embodiments of the present invention, taken in conjunction with the accompanying drawings.

DESCRIPTION OF THE PREFERRED EMBODIMENTS

Embodiment 1

Hereinafter, the desirable embodiments of the present invention will be described in detail with reference to the drawings.

In the following embodiments of the present invention, the "widthwise" direction of a process cartridge B means the direction in which a process cartridge is inserted into, or removed from, the main assembly 14 of an image forming apparatus, and this direction coincides with the direction in which recording medium is conveyed. The "lengthwise" direction of the process cartridge B means the direction which intersects, horizontally and substantially perpendicularly, the direction in which the process cartridge B is inserted into, or removed from, the main assembly 14, and this direction is parallel to the surface of the recording medium, and also intersects, substantially perpendicularly, the direction in which the recording medium is conveyed. The "left-hand side or right-hand side" of the process cartridge B means the left-hand or right-hand side of the process cartridge B as seen from above and behind, in relation to the recording medium which is being conveyed.

Figure 3:
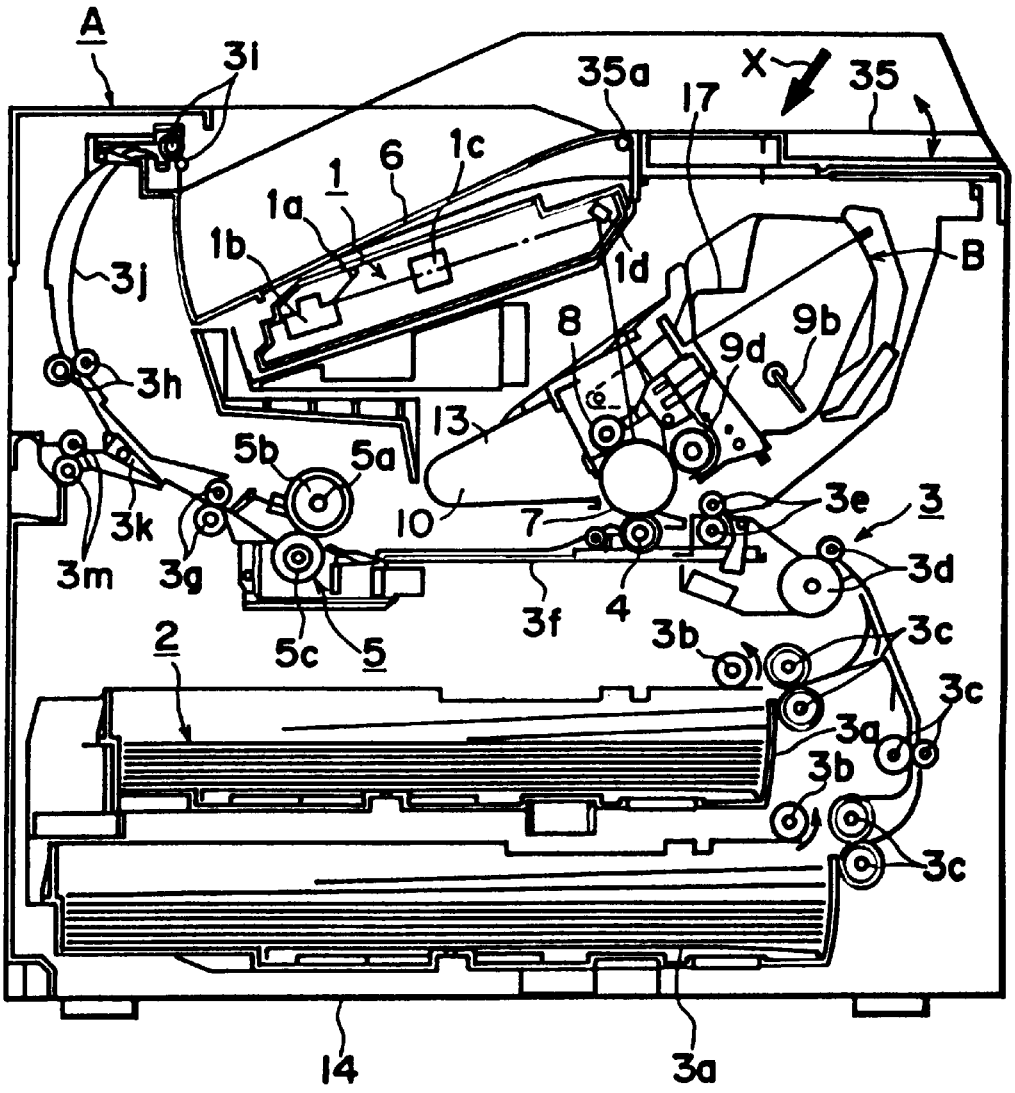
FIG. 3 is a vertical section of a typical image forming apparatus in accordance with the present invention.
Figure 4:
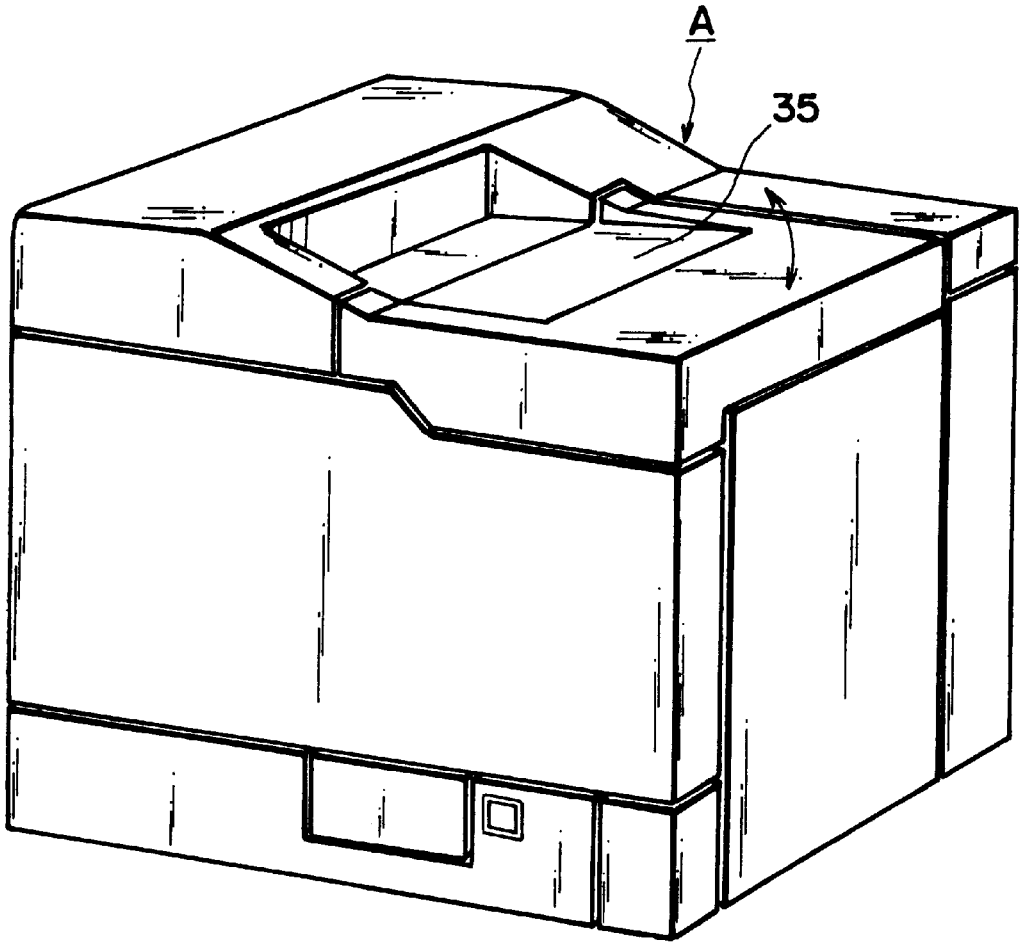
FIG. 4 is an external perspective view of a typical image forming apparatus in accordance with the present invention.

FIG. 3 is a drawing which depicts the structure of an electrophotographic image forming apparatus (laser beam printer) in accordance with the present invention, and FIG. 4 is an external perspective view of the apparatus in FIG. 3 FIGS. 4–7 are also drawings related to the process cartridges in accordance with the present invention. In the following description of the embodiments of the present invention, the top side of the process cartridge B means the side that faces upward when the process cartridge B is in the main assembly 14 of the image forming apparatus, and the bottom side of the process cartridge B means the side that faces downward when the process cartridge B is in the main assembly 14.

Electrophotographic Image Forming Apparatus A and Process Cartridge B

Figure 5:
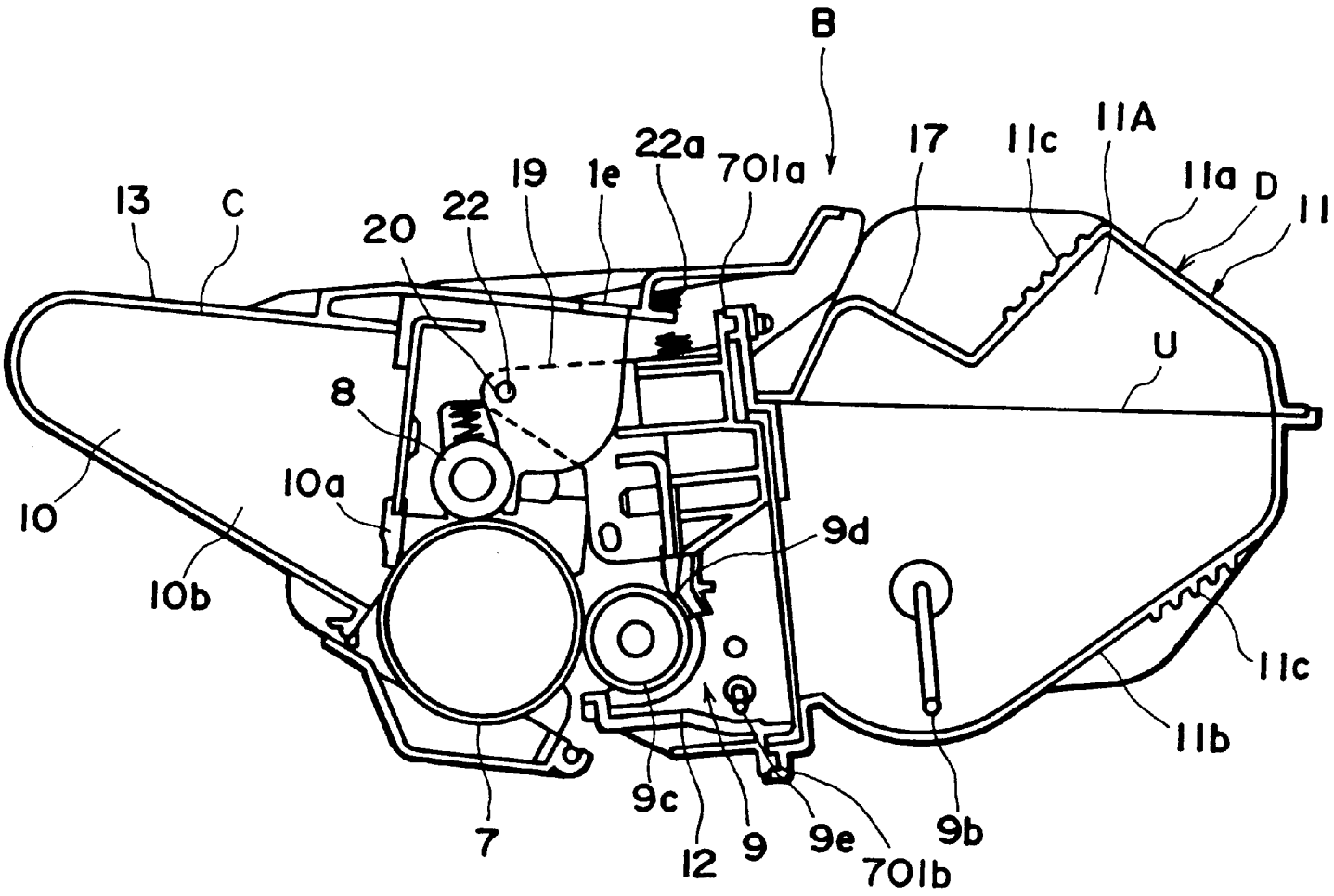
FIG. 5 is a vertical section of a typical process cartridge in accordance with the present invention.

First, referring to FIGS. 3 and 4, a laser beam printer A as an electrophotographic image forming apparatus in accordance with the present invention will be described. FIG. 5 is a vertical cross section of the process cartridge B.

Referring to FIG. 3, this laser beam printer A is a printer which forms an image on a piece of recording medium (recording sheet, OHP sheet, fabric, or the like) through an electrophotographic image forming process; it forms a toner image on an electrophotographic photosensitive member in the form of a drum (hereinafter, "photosensitive drum"). More specifically, the photosensitive drum is charged by a charging means, and a laser beam modulated with image forming data is projected onto the charged photosensitive drum from an optical means, and as a result, a latent image reflecting the image forming data is formed on the photosensitive drum. The latent image is developed into a toner image by a developing means. While the latent image is formed, the recording medium 2 placed in a sheet feeder cassette 3*a* are fed out of the cassette 3*a,* one by one. Then, the recording medium 2 is conveyed to the interface between the photosensitive drum and an image transferring roller 4 as an image transferring means, by conveyer roller pairs 3*c* and 3*d,* and a sheet registering roller pair 3*e,* in such a manner that the recording medium surface facing downward in the cassette 3*a* turns to face upward in the interface, and such that the recording medium arrives at the interface in synchronism with the toner image. Next, the toner image formed on the peripheral surface of the photosensitive drum 7 of the process cartridge B is transferred onto the recording medium 2 by applying electrical voltage to the image transferring roller 4. The recording medium 2 on which the toner image has been transferred is conveyed to a fixing means 5 by a recording medium conveying guide 3*f.* The fixing means 5 comprises a driving roller 5*c,* and an image fixing roller 5*b* which contains a heater 5*a.* The fixing means 5 fixes the toner image having been transferred onto the recording medium 2, to the recording medium 2 by applying heat and pressure to the recording medium 2 and the toner image. Thereafter, the recording medium 2 is conveyed through a turnover path by discharging roller pairs 3*g* and 3*h,* and is discharged into a delivery tray 6 by a discharge roller pair 3*i.* The delivery tray 6 is on the top side of the main assembly 14 of an image forming apparatus A. It should be noted here that a pivotable flapper 3*k* may be operated to discharge the recording medium 2 from the main assembly 14, without conveying the recording medium 2 through the turnover path. In this embodiment, the pickup roller 3*b,* conveying roller pairs 3*c* and 3*d,* registering roller 3*e,* conveying guide 3*f,* discharging roller pairs 3*g,* 3*h,* and 3*i,* and discharge roller pair 3*m* constitute a recording medium conveying means 3.

Referring to FIGS. 3 and 5, in the process cartridge B, the peripheral surface of the photosensitive drum 7 is uniformly charged by applying electrical voltage to a charging roller 8, as a charging means, while rotating the photosensitive drum 7. Next, a laser beam modulated with the image forming data is projected through an exposure opening 1*e* onto the uniformly charged peripheral surface of the photosensitive drum 7, and as a result, a latent image is formed on the peripheral surface of the photosensitive drum 7. Then, the latent image is developed with the use of toner and an image developing means 9. The charging roller 8 is disposed in contact with the photosensitive drum 7 to charge the photosensitive drum 7. The charging roller 8 is rotated by the rotation of the photosensitive drum 7. The image developing means 9 develops the latent image formed on the peripheral surface of the photosensitive drum 7, by supplying the peripheral surface of the photosensitive drum 7 with toner. The optical system 1 comprises a laser diode 1*a,* a polygon mirror 1*b,* a lens 1*c,* and a deflection mirror 1*d.*

As for the operation of the image developing means 9, a toner feeding means 9*b* is rotated to feed the toner within a toner container 11A, to an image developing roller 9*c* which is being rotated, and in which a magnet is fixedly disposed. As a result, a layer of toner triboelectrically charged by a toner regulating blade 9*d* is formed on the peripheral surface of the image developing roller 9*c.* As the image developing roller 9*c* is further rotated, the layer of triboelectrically charged toner enters the image developing zone, that is, the interface between the image developing roller 9*c* and the photosensitive drum 7, in which triboelectrically charged toner particles are transferred from the toner layer to the peripheral surface of the photosensitive drum 7 in a manner to reflect the latent image having been formed on the peripheral surface of the photosensitive drum 7; the latent image is developed, or visualized, into a toner image. As for the regulating blade 9*d,* it regulates the amount by which the toner is coated on the peripheral surface of the image developing roller 9*c,* and at the same time, triboelectrically charges the toner particles being coated on the image developing roller 9*c.* Adjacent to the image developing roller 9*c,* a stirring member 9*e* is rotatively disposed, which circulates the toner particles in the developer (toner) container.

The toner image formed on the photosensitive drum 7 is transferred onto the recording medium 2 by applying a predetermined voltage, the polarity of which is opposite to that of the toner image, to the image transferring roller 4. Thereafter, the toner particles which are remaining on the photosensitive drum 7 are removed by the cleaning means 10; the toner particles remaining on the peripheral surface of the photosensitive drum 7 are scraped off and are collected into a waste toner bin 10*b* by an elastic cleaning blade 10*a* disposed in contact with the peripheral surface of the photosensitive drum 7.

Referring to FIG. 3, as a lid 35 located at the top-right portion of the main assembly 14 is opened by being pivoted about a hinge 35*a,* unillustrated guide rails are exposed, which are located, one for one, on the left and right sides, and diagonally extend downward from the top-right toward the bottom-left. Next, referring to FIG. 6, the process cartridge B is provided with two circular guides, one of which is located at the longitudinal end on the left side, and the other of which is located at the longitudinal end on the right side. The center of the circular guide is in alignment with the rotational axis of the photosensitive drum 7. This circular guide is fitted in a positioning groove located at the bottom end of the guide rail. Further, the process cartridge B is provided with two attitude controlling guides 13*n,* one of which is located at the longitudinal end on the left side, and the other of which is located at the longitudinal end on the right side. The guide 13*n* may be either integral with, or independent from, the circular guide, and fits with the aforementioned guide rail. When inserting the process cartridge B into the apparatus main assembly 14, these circular guides and attitude controlling guides 13*n* are fitted with the correspondent guide rails.

The process cartridge B can be removed by a user from the main assembly 14, by pulling the process cartridge B in the direction from the bottom-left to the top-right, that is, the direction opposite to the aforementioned inserting direction.

When inserting or removing the process cartridge B, the fingers of the user are to be placed on the surface of the indentation 17 of the top frame 11*a* and the bottom surface of the bottom frame 11*b.* The surfaces on which the fingers of the user are to be placed are provided with ridges 11*c.* The toner frame 11, or the toner container portion, is constituted of the top frame 11*a* and the bottom frame 11*b,* which are welded at their interface U.

Frame Structure of Process Cartridge

The process cartridge B in this embodiment comprises an image developing unit D and a cleaning unit C, which are connected to each other by a connecting pin 22 in such a manner that they are allowed to pivot, relative to each other, about the connecting pin 22. The image developing unit D comprises the toner frame 11 and an image development frame 12, which are welded to each other at locations designated by referential codes 701*a* and 701*b.* The toner frame 11 constitutes a toner container (toner storage) which stores toner, and the image development frame 12 holds an image developing means 9, such as the image developing roller 9*c.* The cleaning unit C is constituted of a cleaning unit frame 13, and the functional components: the photosensitive drum 7, the cleaning means 10 such as the cleaning blade 10*a,* and the charging roller 8, which are mounted in the cleaning unit frame 13. Next, referring to FIG. 2, the image development frame 12 and cleaning unit frame 13 are provided with a spring holder (now shown) and spring holder 13*b,* respectively, approximately in the form of a rod, and one end of a compressed compression spring 23 is fitted around the unshown spring holder and the other end of the spring 23 is fitted around the spring holder 13*b.* With this arrangement, the cleaning unit frame 13 and the image development frame 12 are kept under the pressure of the spring 23, which presses the cleaning unit frame 13 and the image development frame 12 in the counterclockwise and clockwise direction, respectively, about a hole, or the connecting pin 22, so that the peripheral surface of the photosensitive drum 7 is kept in contact with spacer rings 9*i* fitted around the longitudinal ends, one for one, of the image developing roller 9*c.*

Method For Connecting Cleaning Unit Frame With Image Development Frame

Figure 6:
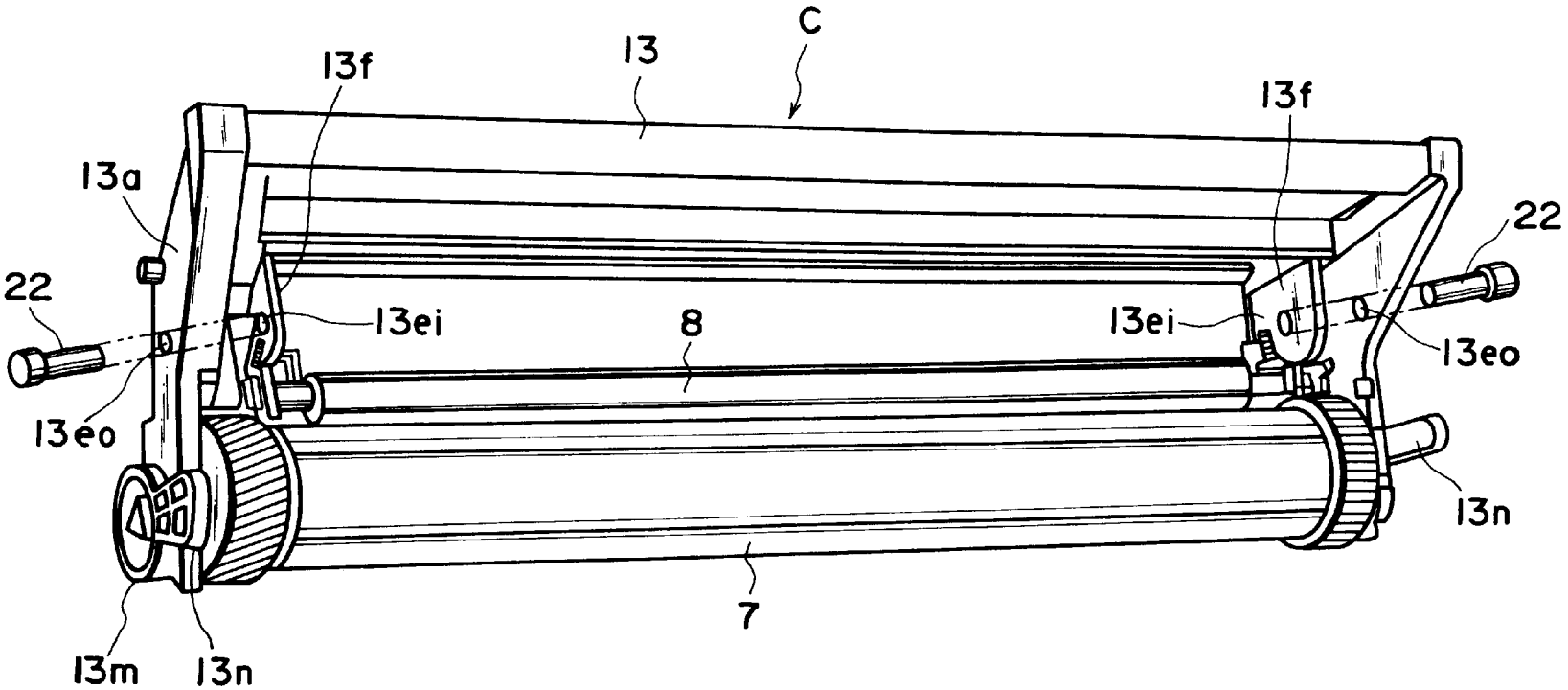
FIG. 6 is a perspective view of a cleaning unit in accordance with the present invention.

The method for connecting the cleaning unit C and the image development unit D will be described with reference to FIGS. 1, 2, 6, and 7. FIG. 6 depicts the cleaning unit frame 13 and the connecting pin 22.

Figure 2:
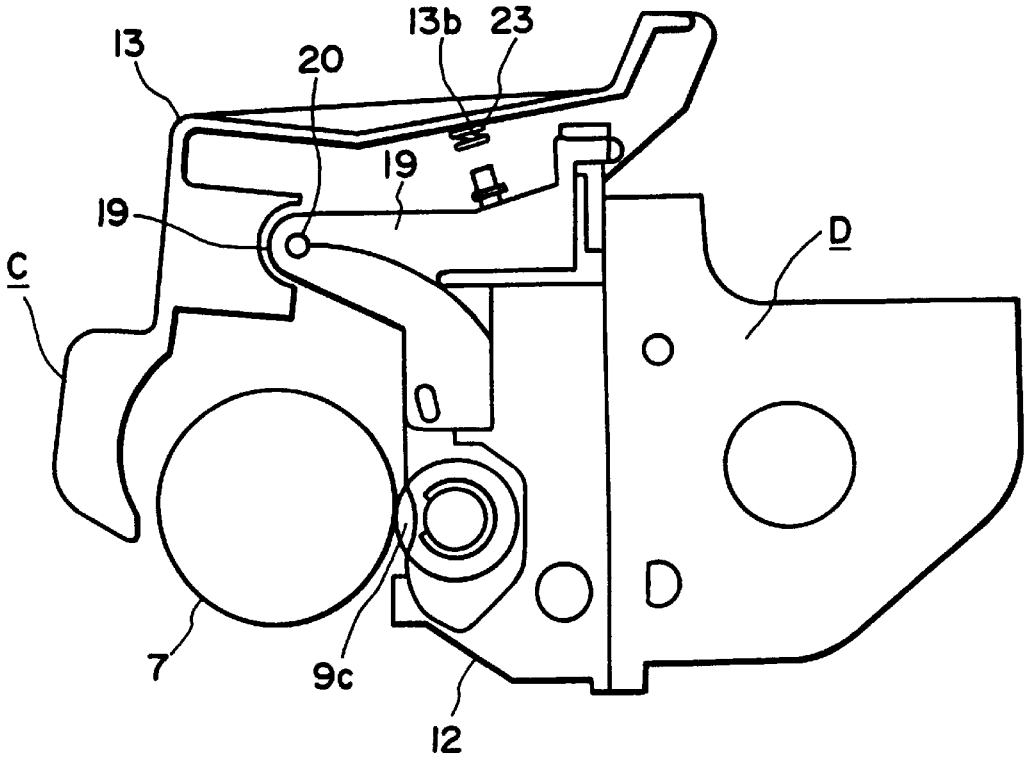
FIG. 2 is a vertical section of the joint between the two frames of a process cartridge, and the areas adjacent thereof, depicting the essential structure thereof, in the first embodiment of the present invention.
Figure 7:
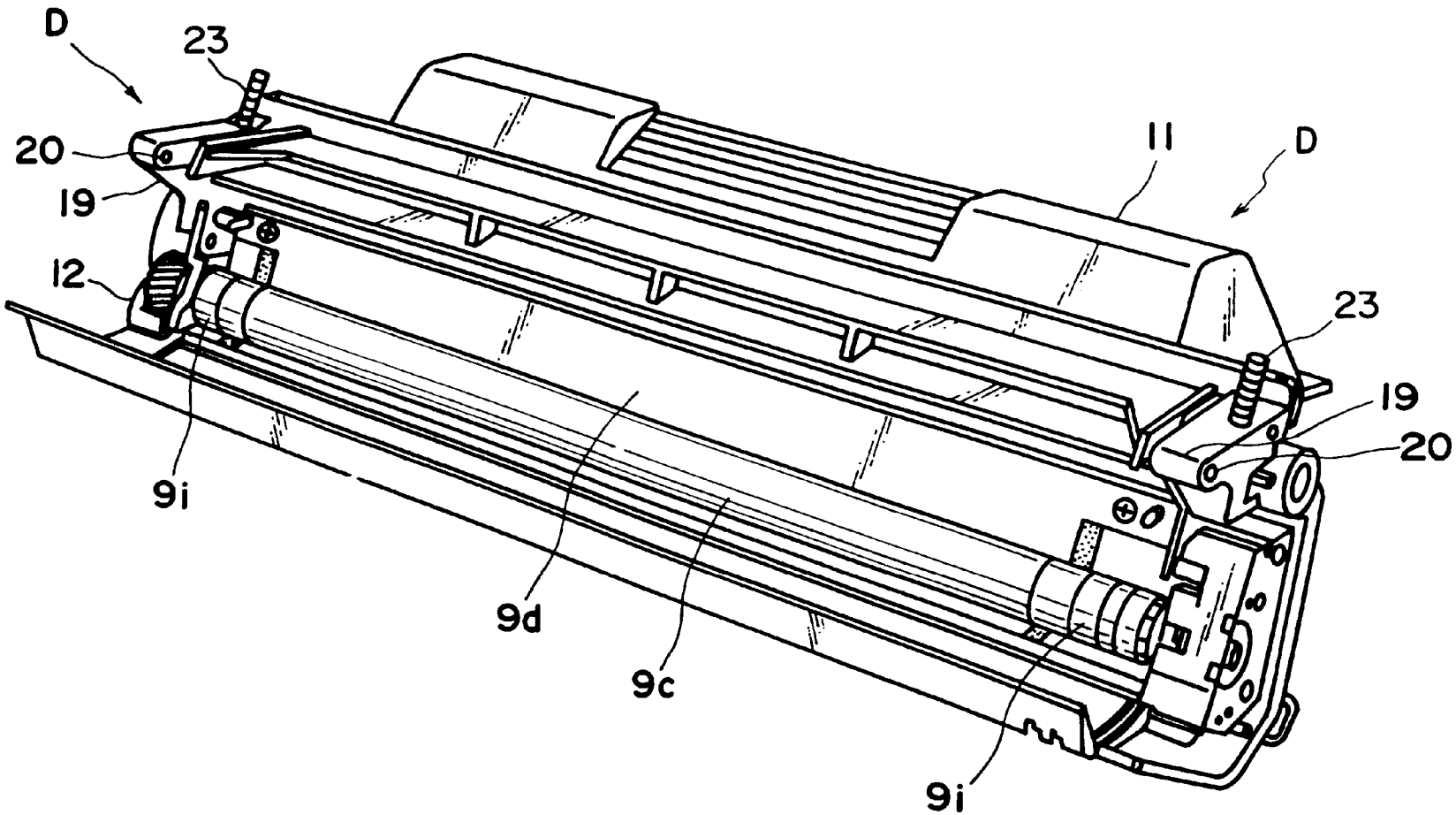
FIG. 7 is a perspective view of an image developing unit in accordance with the present invention.

Referring to FIGS. 2 and 7, each of the longitudinal ends of the image development frame 12 is provided with an arm 19, which projects toward the cleaning unit frame 13. At the end of the arm 19 of the development frame 12, a hole 20 is provided, which is in alignment with the hole of the arm 19 on the other side of the development frame 12. Each longitudinal end of the cleaning unit frame 13 is provided with a lateral plate 13*a,* which is on the outward side, and a lateral plate 13*f,* which is on the inward side. The gap between the two lateral plates 13*a* and 13*f* is slightly larger than the thickness of the arm 19. They are provided with holes 13*eo* and 13*ei,* respectively, which are aligned in the longitudinal direction of the process cartridge B, that is, the direction parallel to the photosensitive drum 7. The diameter of the hole 13*eo* is larger than that of the hole 13*ei.*

The cleaning unit frame 13 and the image developing unit frame 12 are connected in the following manner. First, the arm 19 of the image developing unit frame 12 is inserted into the gap between the outer lateral plate 13*a* and the inner lateral plate 13*f* of the cleaning unit frame 13, roughly aligning the holes 13*e* (13*ei* and 13*eo*) of the cleaning unit frame 13 and the hole 20 of the image developing unit frame 12 with the holes 20 of the image developing unit frame 12 roughly aligned with the holes 13*e* (13*ei* and 13*eo*) of the cleaning unit frame 13. Then, the connecting pin 22 is inserted through the holes 13*e* and the hole 20 from the outside, at both longitudinal ends. The dimensional relation between the external diameter of the connecting pin 22 and the diameter of the hole 13*e* (13*eo* and 13*ei*) of the cleaning unit frame 13 is such that the connecting pin 22 fits in the holes 13*e* in the manner of an interference fit, whereas the dimensional relationship between the external diameter of the connecting pin 22 and the diameter of the hole 20 of the developing unit frame 12 is such that the connecting pin fits in the hole 20 in the manner of a clearance fit; in other words, the pin 22 fits in the hole 13*e* (13*eo* or 13*ei*) of the cleaning unit frame 13 tightly enough so that the pin 22 does not come out unless it is pulled with a force greater than a predetermined force. Therefore, after the two frames are connected by pressing the connecting pin 22 through the holes of the two frames, the cleaning unit frame 13 is pivotally supported by the connecting pin 22.

Figure 1:
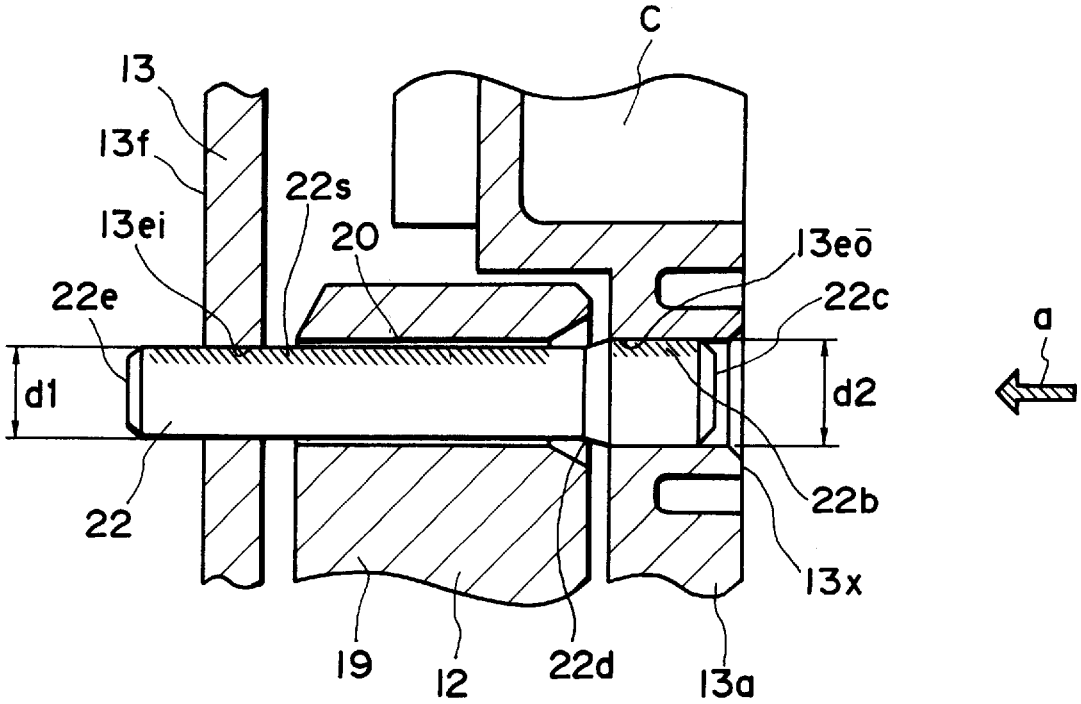
FIG. 1 is a horizontal section of the joint between the two frames of a process cartridge, and the areas adjacent thereof, in the first embodiment of the present invention.

FIG. 1 is a section of the joint between the cleaning unit frame 13 and the image developing unit frame 12, depicting the connecting pin 22 and the area adjacent thereof.

The connecting pin 22 is a pin formed of steel, or nonferrous metallic material such as brass, by cutting, grinding, or cold forming. It is constituted of a small diameter portion 22*s,* which has a diameter d1, an intermediary portion 22*d,* which is tapered, and a large diameter portion 22*b,* which has a diameter d2. An arrow mark designated by a reference character a indicates the direction in which the connecting pin 22 is inserted; the drawing depicts the connecting pin 22 after the process cartridge B has been completely assembled. As is evident from the drawing, the connecting pin 22 is inserted inward into the holes from the outward side of the cleaning unit frame 13.

In this embodiment, the diameter d1 of the small diameter portion 22*s* of the connecting pin 22 is 3.0 mm (maximum tolerance: 0.0000 mm; minimum tolerance: −0.0015 mm); the diameter d2 of the large diameter portion of the connector pin 22 is 3.5 mm (maximum tolerance: +0.2200 mm; minimum tolerance: +0.0040 mm, in JIS standard M8). The diameters of the holes 13*ei,* 13*eo,* and 20*a* are 3.0 mm (maximum tolerance: −0.0400 mm; minimum tolerance: −0.0650 mm), 3.5 mm (maximum tolerance: −0.0300 mm; minimum tolerance: −0.0600 mm), and 3.0 mm (maximum tolerance: +0.0280 mm; minimum tolerance: +0.0140 mm, in JIS Standard E8), correspondingly.

Therefore, as the connecting pin 22 is put through the holes 13*eo,* 20, and 13*ei,* the small diameter portion 22*s* of the connecting pin 22 fits in the holes 13*ei* of the cleaning unit frame 13, with the presence of interference, and also in the hole 20 of the image developing unit frame 12, with the presence of clearance, whereas the large portion 2*d* of the connecting pin 22 fits in the hole 13*eo* of the cleaning unit frame 13, with the presence of interference. Consequently, the image developing unit frame 12 becomes pivotable about the connecting pin 22. As is evident from the above description, according to the frame connecting method in this embodiment, the connecting pin 22 is fitted into the two holes of the cleaning unit frame 13, in the form of interference fitting, being rendered more resistant to the force which works on the connecting pin 22 in the direction to pull out the connecting pin 22.

The measured force necessary to pull out the connecting pin 22 by applying pressure to the intermediary portion 22*d* was approximately 5 kg, which is large enough to render the connecting pin 22 resistant to the force that works on the connecting pin 22 in the direction to pull out the connecting pin 22 in the normal usage of the process cartridge B.

Figure 8:
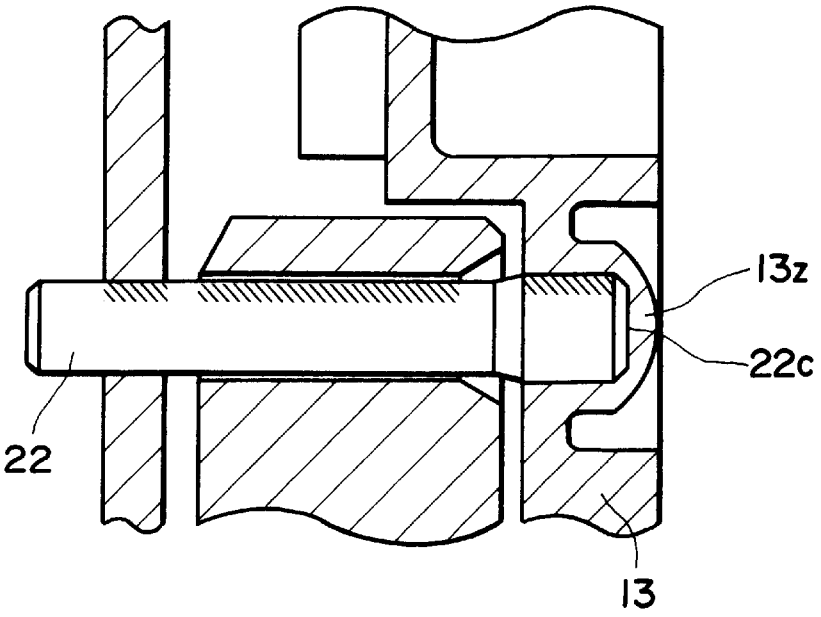
FIG. 8 is a horizontal section of the joint between the two frames of a process cartridge, and the areas adjacent thereof, in the first embodiment of the present invention.
Figure 9:
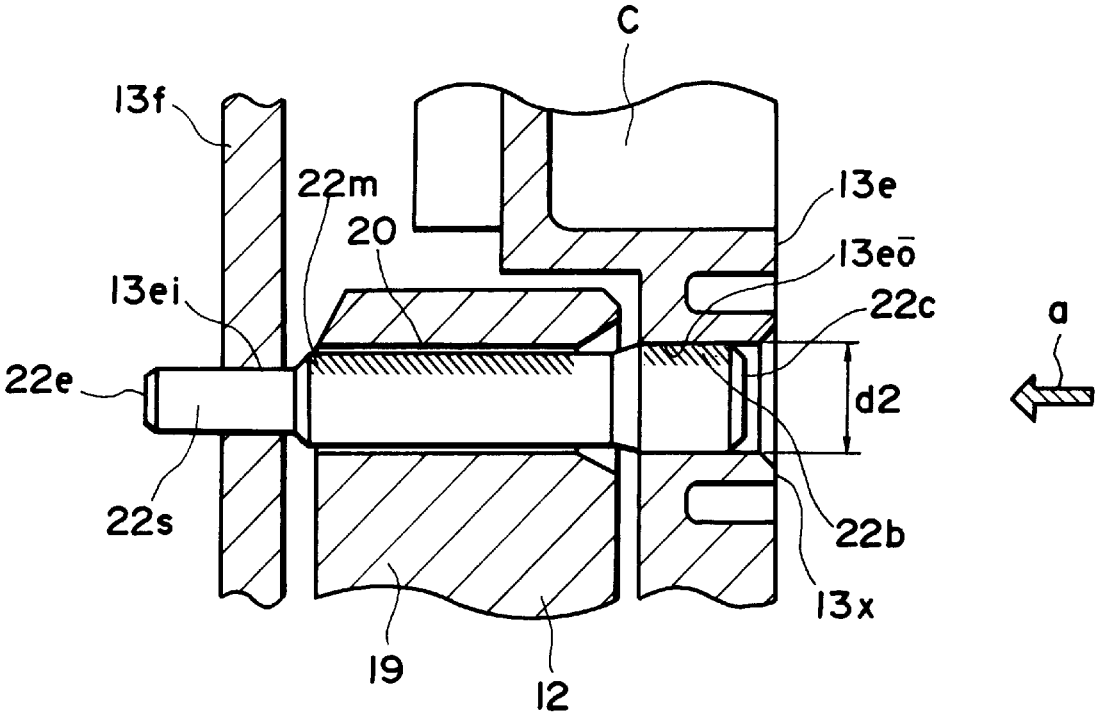
FIG. 9 is a horizontal section of the joint between the two frames of a process cartridge, and the areas adjacent thereof, in the second embodiment of the present invention.

Referring to FIG. 1, the designs of the cleaning unit frame 13 and the connecting pin 22 are such that the outward end portion 22*c* of the fully inserted connecting pin 22 is slightly below, or even with, the outward surface 13*x* of the cleaning unit frame 13. The objective of this arrangement is to prevent the user from accidentally pulling out the connecting pin 22, that is, from accidentally separating the cleaning unit C from the image developing unit D. A structure that can more reliably prevent the connecting pin 22 from being pulled out is shown in FIG. 8. In this case, the end portion 22*c* of the connecting pin 22 is covered with a cap portion 13*z* formed by melting a portion of the cleaning unit frame 13, adjacent to the connecting pin 22, so that the connecting pin 22 cannot be pulled out. In this embodiment, thermal welding is used to cover the end portion 22*c* by melting the portion of the cleaning unit frame 13, but vibration welding, supersonic welding, gluing, or the like may be used to obtain the same result. Further, resin may be applied to the end portion 22*c* and the adjacencies thereof in the manner of cladding.

Embodiment 2

In Embodiment 2, the connecting pin 22 comprises three portions with different diameters: a small diameter portion 22*s;* a medium diameter portion 22*m,* the diameter of which is larger than that of the smaller diameter portion 22*s;* and a large diameter portion 22*b,* the diameter of which is larger than that of the medium diameter portion 22*m.* The small diameter portion 22*s* is pressed into the hole 13*ei* of the inward plate 13*f* of the cleaning unit frame 13, and the large diameter portion 22*b* is pressed into the hole 13*eo* of the outward plate 13*a* of the cleaning unit frame 13. The medium diameter portion 22*m* is fitted in the hole 20 of the arm 19 of the image developing unit frame 12, in a freely rotatable manner.

This structural arrangement affords more latitude in selecting the diameters of the holes 13*ei,* 20, and 13*ei,* and the diameters of the portions 22*s,* 22*m,* and 22*b* of the connecting pin 22.

Embodiment 3

Figure 10:
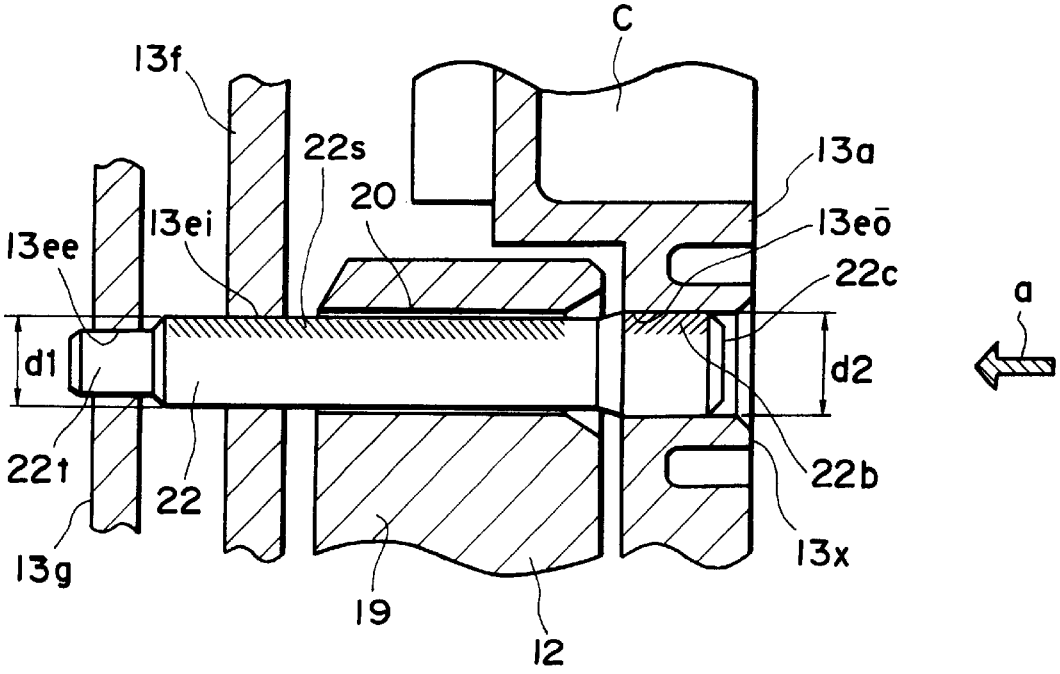
FIG. 10 is a horizontal section of the joint between the two frames of a process cartridge, in the third embodiment of the present invention.

FIG. 10 depicts the third embodiment of the present invention. According to this embodiment, the cleaning unit frame 13 is provided with a bracket 13*g* with a hole 13*ee,* in addition to the outward plate 13*a* and inward plate 13*f.* The bracket 13*g* is on the inward side of the inward plate 13*f,* a predetermined distance apart from the inward plate 13*f.* The hole 13*ee* is slightly smaller in diameter than the hole 13*ei,* and is in alignment with the holes 13*eo* and 13*ei.*

On the other hand, the connecting pin 22 comprises a larger diameter portion 22*b,* a small diameter portion 22*s,* which is immediately next to the large diameter portion 22*b,* and an anchor portion 22*t,* which is immediately next to the small diameter portion 22*s.* The large diameter portion 22*b* fits in the hole 13*eo* of the outward plate 13*a* of the cleaning unit frame 13, in the manner of an interference fit, whereas the small diameter portion 22*s* of the connecting pin 22 fits in the hole 20 of the arm 19 of the image developing unit frame 12, in the manner of a clearance fit. The anchor portion 22*t* of the connecting pin 22, which is tapered toward the inward end, is pressed into the hole 13*ee* of the bracket 13*g*. Further, the small diameter portion 22*s* of the connecting pin 22 fits in the hole 13*ei* of the cleaning unit frame 13, in the manner of an interference fit.

According to the third embodiment, the connecting pin 22 is more firmly held by the cleaning unit frame 13, compared to the preceding embodiments.

As is evident from the above description of the preferred embodiments of the present invention, according to the present invention, the connecting pin that connects the first and second frames of a process cartridge is fixed to two or more locations on the first frame, providing a functional advantage in that the connecting pin is rendered more resistant to the force that works on the connecting pin in the direction to pull it out. Therefore, the connecting pin does not unexpectedly come out.

Further, the process cartridge structure in accordance with the present invention renders the molding of the first frame easier. Consequently, the dimensional accuracy of the first frame is improved. Further, in terms of the economic aspect of the process cartridge B, the cost of the process cartridge B can be reduced, since the process cartridge structure in accordance with the present invention makes it easier to produce the metallic mold for the process cartridge.

While the invention has been described with reference to the structures disclosed herein, it is not confined to the details set forth, and this application is intended to cover such modifications or changes as may come within the purposes of the improvements or the scope of the following claims.

What is claimed is:

1. A coupling pin for coupling a first frame and a second frame of a process cartridge detachably mountable relative to a main assembly of an electrophotographic image forming apparatus, comprising:

(a) a first shaft portion for being pressfitted into a first hole formed in the first frame;

(b) a second shaft portion for being pressfitted into a second hole formed in the first frame, wherein said second shaft portion is upstream of said first shaft portion in a direction of press-fitting of said coupling pin, and said second shaft portion has an outer diameter which is larger than that of said first shaft portion; and (c) a third shaft portion for being loosely fitted into a hole formed in said second frame with a gap between said third shaft portion and the inside surface of the hole of said second frame.

2. A coupling pin according to claim 1, wherein said third shaft portion is between said first and second shaft portions in the press-fitting direction.

3. A coupling pin according to claim 1, wherein said second shaft portion has a length, measured in its longitudinal direction, which is shorter than the depth of the second hole.

4. A coupling pin according to claim 1, wherein said second shaft portion has a length, measured in its longitudinal direction, which is longer than that of said first shaft portion, and said third shaft portion has a length longer than that of said second shaft portion.

5. A coupling pin according to claim 1, wherein said first frame supports an electrophotographic photosensitive member, and said second frame supports a developing member for supplying a developer to said photosensitive member to develop an electrostatic latent image formed on said photosensitive member.

6. A coupling pin according to claim 1, wherein said third shaft portion has an outer diameter which is substantially the same as that of said first shaft portion.

7. A coupling pin according to claim 1, wherein said third shaft portion has an outer diameter which is larger than that of said first shaft portion and smaller than that of said second shaft portion.

8. A coupling pin according to claim 1, wherein said first and third shaft portions have outer diameters of approximately 3.0 mm, and said second shaft portion has an outer diameter of approximately 3.5 mm.

9. A coupling pin for coupling a first frame and a second frame of a process cartridge detachably mountable relative to a main assembly of an electrophotographic image forming apparatus, comprising:

(a) a first shaft portion for being press-fitted into a first hole formed in the first frame;

(b) a second shaft portion for being press-fitted into a second hole formed in the first frame, wherein said second shaft portion is upstream of said first shaft portion in a direction of press-fitting of said coupling pin, and said second shaft portion has an outer diameter which is larger than that of said first shaft portion; and (c) a third shaft portion for being loosely fitted into a hole formed in said second frame with a gap between said third shaft portion and an inside surface of the hole of said second frame; and (d) a fourth shaft portion for being press-fitted to a third hole formed in said first frame, wherein said fourth shaft portion is downstream of said first shaft portion in the press-fitting direction, and said fourth shaft portion has an outer diameter which is smaller than that of said first shaft portion.

10. A process cartridge detachably mountable relative to a main assembly of an electrophotographic image forming apparatus, comprising:

(a) an electrophotographic photosensitive member;

(b) process means actable on said photosensitive member;

(c) a first frame;

(d) a second frame;

(e) a coupling pin for coupling said first and second frames, said coupling pin including:

(i) a first shaft portion for being pressfitted into a first hole formed in the first frame;

(ii) a second shaft portion for being pressfitted into a second hole formed in the first frame, wherein said second shaft portion is upstream of said first shaft portion in a direction of press-fitting of said coupling pin, and said second shaft portion has an outer diameter which is larger than that of said first shaft portion; and (iii) a third shaft portion for being loosely fitted into a hole formed in said second frame with a gap between said third shaft portion and an inside surface of the hole of said second frame.

11. A process cartridge according to claim 10, wherein said third shaft portion is between said first and second shaft portions in the press-fitting direction.

12. A process cartridge according to claim 10, wherein said second shaft portion has a length, measured in its longitudinal direction, which is shorter than the depth of the second hole.

13. A process cartridge according to claim 10, wherein said second shaft has a length, measured in its longitudinal direction, which is longer than that of said first shaft portion, and wherein said third shaft portion has a length longer than that of said second shaft portion.

14. A process cartridge according to claim 10, wherein said first frame supports an electrophotographic member, and said second frame supports a developing member for supplying a developer to said photosensitive member to develop an electrostatic latent image formed on said photosensitive member.

15. A process cartridge according to claim 10, wherein said third shaft portion has an outer diameter which is substantially the same as that of said first shaft portion.

16. A process cartridge according to claim 10, wherein said third shaft portion has an outer diameter which is larger than that of said first shaft portion and smaller than that of said second shaft portion.

17. A process cartridge according to claim 10, wherein said first and third shaft portions have outer diameters of approximately 3.0 mm, and said second shaft portion has an outer diameter of approximately 3.5 mm.

18. A process cartridge according to claim 10, further comprising a fourth shaft portion for being press-fitted to a third hole formed in said first frame, wherein said fourth shaft portion is downstream of said first shaft portion in the press fitting direction, and said fourth shaft portion has an outer diameter which is smaller than that of said first shaft portion.

19. A process cartridge according to claim 10, wherein said process cartridge contains as a unit said photosensitive member and at least one of a charging member for charging said photosensitive member, a developing member for developing a latent image formed on said photosensitive member and a cleaning member for removing a developer remaining on said photosensitive member, as said process means, wherein said process cartridge is detachably mountable relative to the main assembly of said image forming apparatus as a unit.

20. A coupling pin for coupling a first frame and a second frame of a process cartridge detachably mountable relative to a main assembly of an electrophotographic image forming apparatus, comprising:

(a) a first shaft portion for being press-fitted into a first hole formed in the first frame;

(b) a second shaft portion for being press-fitted into a second hole formed in the first frame, wherein said second shaft portion is upstream of said first shaft portion in a direction of press-fitting of said coupling pin, and said second shaft portion has an outer diameter which is larger than that of said first shaft portion; and (c) a third shaft portion for being fitted with a clearance fit into a hole formed in said second frame, wherein said third shaft portion is between said first and second shaft portions in the press-fitting direction, wherein said second shaft portion has a length, measured in its longitudinal direction, which is shorter than the depth of the second hole, and wherein said first frame supports an electrophotographic photosensitive member, and said second frame supports a developing member for supplying a developer to said photosensitive member to develop an electrostatic latent image formed on said photosensitive member.

21. A coupling pin according to claim 20, wherein said third shaft portion has a length longer than that of said second shaft portion.

22. A coupling pin according to claim 20, wherein a portion of said third shaft portion has an outer diameter which is larger than that of said first shaft and smaller than that of said second shaft portion.

23. A coupling pin according to claim 20, wherein the diameter of said first shaft portion is approximately 3.0 mm and the diameter of said second shaft portion is approximately 3.5 mm.

24. A coupling pin according to claim 20, wherein said first and second shaft portions are press-fitted into said first and second holes, respectively, so that a force approximately 5 kg is required to drive said coupling pin from said first frame.

25. A coupling pin for coupling a first frame and a second frame of a process cartridge detachably mountable relative to a main assembly of an electrophotographic image forming apparatus, comprising:

(a) means for producing an interference fit with a first hole formed in the first frame;

(b) means for producing an interference fit with a second hole formed in the first frame and for resting inside the outward surface of the second hole when said coupling pin is inserted into the first and second holes, the second hole being larger than the first hole; and (c) means for producing a clearance fit with a hole formed in said second frame, wherein means (c) is between means (a) and means (b) in the press-fitting direction, wherein said first frame supports an electrophotographic photosensitive member, and said second frame supports a developing member for supplying a developer to said photosensitive member to develop an electrostatic latent image formed on said photosensitive member.

26. A coupling pin according to claim 25, wherein the diameter of said means (a) is approximately 3.0 mm and the diameter of said means (b) is approximately 3.5 mm.

27. A coupling pin according to claim 25, wherein means (a) and (b) together comprise means for preventing said coupling pin from being driven out of said first frame with a force of less than approximately 5 kg.

28. A process cartridge detachably mountable relative to a main assembly of an electrophotographic image forming apparatus, comprising:

(a) an electrophotographic photosensitive member;

(b) a developing member for supplying developer to said electrophotographic photosensitive member to develop an electrostatic latent image formed on said electrophotographic photosensitive member;

(c) a first frame supporting said electrophotographic photosensitive member;

(d) a second frame supporting said developing member; and (e) a coupling pin for coupling said first and second frames, said coupling pin including:

a first shaft portion for being press-fitted into a first hole formed in said first frame;

a second shaft portion for being press-fitted into a second hole formed in said first frame, wherein said second shaft portion is upstream of said first shaft portion in a direction of press-fitting of said coupling pin, and said second shaft portion has an outer diameter which is larger than that of said first shaft portion; and a third shaft portion for being fitted with a clearance fit into a hole formed in said second frame, wherein said third shaft portion is between said first and second shaft portions in the press-fitting direction, wherein said second shaft portion has a length, measured in its longitudinal direction, which is shorter than the depth of the second hole.

29. A process cartridge according to claim 28, wherein said third shaft portion has a length longer than that of said second shaft portion.

30. A process cartridge according to claim 28, wherein a portion of said third shaft portion has an outer diameter which is larger than that of said first shaft portion and smaller than that of said second shaft portion.

31. A process cartridge according to claim 28, wherein the diameter of said first shaft portion is approximately 3.0 mm, the diameter of said second shaft portion is approximately 3.5 mm, the diameter of the first hole in said first frame is approximately 3.0 mm, the diameter of the second hole in said first frame is approximately 3.5 mm.

32. A process cartridge according to claim 28, wherein said first and second shaft portions are press-fitted into said first and second holes, respectively, so that a force of approximately 5 kg is required to drive said coupling pin from said first frame.

33. A process cartridge detachably mountable relative to a main assembly of an electrophotographic image forming apparatus, comprising:

(a) an electrophotographic photosensitive member;

(b) a developing member for supplying developer to said electrophotographic photosensitive member to develop an electrostatic latent image formed on said electrophotographic photosensitive member;

(c) a first frame supporting said electrophotographic photosensitive member;

(d) a second frame supporting said developing member; and (e) a coupling pin for coupling said first and second frames, said coupling pin including:

means for producing an interference fit with a first hole formed in the first frame;

means for producing an interference fit with a second hole formed in the first frame and for resting inside the outward surface of the second hole when said coupling pin is inserted into the first and second holes, the second hole being larger than the first hole; and means for producing a clearance fit with a hole formed in said second frame.

34. A process cartridge according to claim 25, wherein the diameter of the diameter of the first hole in said first frame is approximately 3.0 mm, the diameter of the second hole in said first frame is approximately 3.5 mm.

35. A process cartridge according to claim 25, wherein said interference-fit producing means together comprise means for preventing said coupling pin from being driven out of said first frame with a force of less than approximately 5 kg.

* * * * *